US009837699B2

(12) United States Patent
Dai

(10) Patent No.: US 9,837,699 B2
(45) Date of Patent: Dec. 5, 2017

(54) MULTI-ELEMENT WINDOW ANTENNA

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 327 days.

(21) Appl. No.: 14/821,713

(22) Filed: Aug. 8, 2015

(65) Prior Publication Data

US 2017/0040662 A1 Feb. 9, 2017

(51) Int. Cl.

| | |
|---|---|
| ***H01Q 1/12*** | (2006.01) |
| ***H01Q 21/28*** | (2006.01) |
| ***H01P 5/16*** | (2006.01) |
| ***H01Q 9/42*** | (2006.01) |
| ***H01Q 5/371*** | (2015.01) |

(52) U.S. Cl.

CPC ..... *H01Q 1/1271* (2013.01); *H01P 5/16* (2013.01); *H01Q 5/371* (2015.01); *H01Q 9/42* (2013.01); *H01Q 21/28* (2013.01)

(58) Field of Classification Search

CPC ..... H01Q 1/1271; H01Q 1/50; H01Q 21/30; H01Q 1/3291; H01Q 21/28

See application file for complete search history.

(56) References Cited

U.S. PATENT DOCUMENTS

2012/0098715 A1* 4/2012 Dai ..... H01Q 1/1278 343/712

2012/0098716 A1* 4/2012 Dai ..... H01Q 13/10 343/713

* cited by examiner

*Primary Examiner* — Dameon E Levi
*Assistant Examiner* — David Lotter
(74) *Attorney, Agent, or Firm* — Cohen & Grigsby, P.C.

(57) ABSTRACT

A window antenna wherein a pair of embedded wires are laminated inside a glazing and a connector is attached to the joined end of the wires and to a signal input. A first segment of the embedded antenna wire is oriented parallel to the window frame to form a coupled transmission line divider. The power divider with coupled transmission lines affords adding more than one wire to the window antenna for wideband and multiband application while also providing a feed to the antenna to form a diversity antenna system.

28 Claims, 7 Drawing Sheets

MEASUREMENT SETUP

| | | |
|---|---|---|
| NAME | : SWEEP[T3] | |
| DATE | : 19/11/2014 | |
| TIME | : 19:14:22 | |
| INSTRUMENT | : ZVH8-102211/028 | |
| FIRMWARE VERSION | : V1.43 | |
| INSTRUMENT MODE | : NETWORK ANALYZER | |
| MEAS MODE | : VECTOR | |
| BRIDGE MODE | : S22 | |
| FORMAT | : MAGNITUDE | |
| CALIBRATION STATE | : CalHA | |
| APERTURE STEPS | : ··· | |
| UPLINK | : ··· | |
| DOWNLINK | : ··· | |
| CHANNEL | : ··· | |
| CENTER FREQUENCY | : 475 | MHz |
| FREQUENCY OFFSET | : 0 | Hz |
| SPAN | : 650 | MHz |
| REF LEVEL | : 0.0 | dB |
| REF OFFSET | : 0.0 | dB |
| RANGE | : 50 | dB |
| RF ATTENUATION | : MANUAL | |
| RF ATTENUATOR | : 0 | dB |
| PREAMPLIFIER | : OFF | |
| RF INPUT | : 50 Ohm | |
| BW | : 10 | kHz |
| SWT | : 81 | ms |
| NUMBER OF POINTS | : 801 | |
| TRIGGER MODE | : FREE RUN | |
| TRIGGER LEVEL | : ··· | |
| TRIGGER DELAY | : ··· | |
| TRACE MODE | : CLEAR/WRITE | |
| TRACE MATH | : OFF | |
| TRACE DETECTOR | : SAMPLE | |
| LIMIT LINE 1 | : ··· | |
| LIMIT LINE 2 | : ··· | |
| INTERNAL DC BIAS | : OFF | |

MEASUREMENT RESULTS

| | |
|---|---|
| RESULT LIMIT LINE 1 | : ··· |
| RESULT LIMIT LINE 2 | : ··· |
| AVERAGE COUNT | : ··· |

MARKERS

| | | |
|---|---|---|
| M1 : | 174.375MHz : | -2.07 dB |
| M2 : | 230.1875MHz : | -2.44 dB |
| M3 : | 470.125MHz : | -5.18 dB |
| M4 : | 605.8125MHz : | -2.55 dB |
| M5 : | 800MHz : | -4.79 dB |

FIG. 6
CONTINUED

MULTI-ELEMENT WINDOW ANTENNA

TECHNICAL FIELD

The present invention generally relates to vehicle antennas, and more specifically to window antennas that include electrical conductors such as silver ceramic ink that is screen printed on a surface of a glazing of a window laminate and/or, alternatively, fine wires that are laid on a surface of the interlayer of the laminated glazing.

BACKGROUND OF THE INVENTION

As an alternative to standard whip antennas and roof mount mast antennas, prior art automotive antennas have included concealed window antennas that have silver printed antennas in the vehicle glazing. More recently, embedded wire antennas of quarter or half wavelength also have been used in laminated windshields and back windows. Traditionally, antenna windshields have included a wire that is embedded in an interlayer of polyvinyl butyral that is sandwiched between a pair of glass sheets. A galvanized, flat cable connector connected the wire antenna to the vehicle electronic module. Before lamination of the vehicle glazing, one end of the connector was soldered to an end of the antenna wire on the interlayer. The other end of the connector extended from the edge of the laminated glazing to provide a connection to the vehicle electronic module.

Many of the wire antenna designs in the prior art have located the wire in the middle of the windshield or glass window for better performance. For example, U.S. Pat. No. 3,576,576 titled "Concealed Windshield Broadband Antenna" assigned to General Motors discloses a pair of L-shaped wire conductors that are fed at the bottom center of the windshield, travel up the middle of the windshield, and split at top of the windshield to form a pair of L-shaped wires for AM and FM reception. U.S. Pat. No. 3,728,732 titled "Window Glass Antenna" assigned to Asahi Glass Company uses a similar pair of L-shaped wire conductors as an FM antenna with an added separated AM antenna wire that is located on the bottom of the windshield. The antenna elements are connected to a radio receiver through a switch that connects either the FM or AM antenna to the radio receiver. U.S. Pat. No. 3,845,489 titled "Window Antenna" assigned to Saint-Gobain Industries discloses an antenna that includes a first "T" shape antenna in the middle of the windshield and a second antenna that embraces the first antenna and follows the windshield frame. Both antennas are attached to a common terminal in the bottom center of the windshield. The dimensions of both antennas are complementary and produce in-phase output for AM and FM signals. U.S. Pat. No. 4,602,260 titled "Windshield Antenna" assigned to Hans Kolbe & Co. discloses an active windshield antenna with separated transmission paths for a low frequency low medium short wave region and an ultra-short wave region. The antenna wire starts from the antenna terminal and extends parallel to the frame. The antenna wire turns at the middle of the windshield so that the portion of the antenna wire on the middle of the window is the main antenna radiation element.

Such prior art designs have focused on AM and FM antennas in the VHF frequency band that have a long, visible wire in the middle of the windshield. It is generally preferred that the antenna wire should avoid a feed location at the bottom center of the windshield. That is because a printed wiper heating circuit that is typically located there can cause possible EMC interference for the antenna. Also, the antenna wire should be kept away from the 3$^{rd}$ visor area that is located at the top center of the windshield. Vehicles equipped with rain sensors and other windshield mounted electronics such as automatic high beam control, night vision cameras, adaptive speed control, etc. commonly have sensors that are mounted in close proximity to the rear view mirror in the 3$^{rd}$ visor area. Antennas in those areas are subject to RF interference in antenna reception.

There has been rapid growth in the demand for vehicle electronics so that more and more antennas are being integrated into the vehicle. Particularly at FM and TV frequencies, antenna systems require multiple antennas to provide diversity operation that overcomes multipath and fading effects. In most cases, separate antennas and antenna feeds are used to meet those demands. Therefore, there was a need in the prior art for an antenna, particularly an embedded wire antenna, that is capable of supporting multiple frequency bands that serve different applications. Furthermore, there was a need in the prior art for an improved wire antenna with multiband characteristics, good performance, and a less visible wire in the daylight opening of the windshield.

SUMMARY OF THE INVENTION

The presently disclosed invention includes an antenna window that has at least one ply such as an outer glass ply, an interlayer such as a plastic interlayer, at least two electrical conductors such as a pair of thin conductive wires that are located on at least one of the ply and the interlayer. For example, the conductors can be adhered to or embedded in the ply or the interlayer. Each of the conductors has respective first longitudinal segments that are joined with respective second longitudinal segments that define a terminal end of the electrical conductor. Each of the first longitudinal segments are located parallel to the portal edge of the window frame and each of the second longitudinal segments are positioned such that at least a portion of the second longitudinal segment is non-parallel to the first longitudinal segment of the respective conductor. The first longitudinal segments each are connected together at one end at a junction. The antenna window can further include an inner glass ply and a connector such as a galvanized connector that is soldered or otherwise connected to the junction of the ends of the first longitudinal segments of the conductive wires near the edge of a windshield. The connector extends outside of the outer edge of the at least one ply and the outer edge of the interlayer and is connected to a coaxial cable or other antenna module input.

The second longitudinal segment of the antenna wire is located in the daylight area of the glazing and the first longitudinal segment lies parallel to and closely proximate to the window frame. The second longitudinal segment of the wire is the primary antenna radiation element. The first longitudinal segment is mainly used to transfer antenna signals between the second longitudinal segment and an antenna output port such as an antenna connector. Each antenna wire is a monopole antenna that typically has a total length of a quarter wavelength. It can be generally referred to as a $\lambda/4$ monopole. For an antenna with two monopoles, the first longitudinal segment of both monopoles is oriented parallel to each other and parallel to the edge of the window frame and is electrically connected to an antenna connector at one end of the first longitudinal segment. The other end of the first longitudinal segment is connected to one end of the second longitudinal segment of the monopole antennas and extends to the daylight opening in an orthogonal or squared direction.

When two monopoles are closely spaced, the orientation of the antenna elements can be important in determining isolation between the antennas. The degree of isolation can be increased when the two monopoles are orthogonally oriented. Multi-band or wideband antenna performance can be achieved when improved isolation between the monopoles affords independent tuning of each monopole to different resonant frequencies. In addition, orthogonal oriented monopoles can radiate or receive antenna signals at different polarizations. For example, TV antennas are required to receive radio frequency signals at both horizontal and vertical polarizations.

The first longitudinal segments of the antenna wires, together with the antenna connector and the window frame form a coupled transmission line power divider. The coupled transmission line power divider not only provides a convenient antenna feed at any point around the perimeter of the window slot, but also affords opportunity for improved antenna tuning and impedance matching. The characteristic impedance of the coupled transmission line can be designed to cause the wire antenna impedance to match the impedance of a coaxial cable or the input impedance of the electronic device which often defined as 50Ω.

To form a coupled transmission line with window frame, the first longitudinal segments of the antenna wires must be located near the edge of the ply such as a glass ply. The edge of the ply is normally painted with dark ink so that the first longitudinal segments are not visible to vehicle occupants. Because the portions of the antenna in the daylight opening are less visible, the wire antenna designs of the presently disclosed invention provide a glazing with better aesthetic appearance than traditional designs in the prior art.

In an example implementation, the first resonant bandwidth may correspond to TV band 3 of 174-240 MHz and the second resonant bandwidth may correspond to TV bands 4 and 5 of 470-800 MHz.

BRIEF DESCRIPTION OF THE DRAWINGS

For a more complete understanding of the presently disclosed invention, reference should now be had to the embodiments illustrated in greater detail in the accompanying drawings and described below by way of examples of the invention. In the drawings.

DETAILED DESCRIPTION OF THE INVENTION

Figure 1:
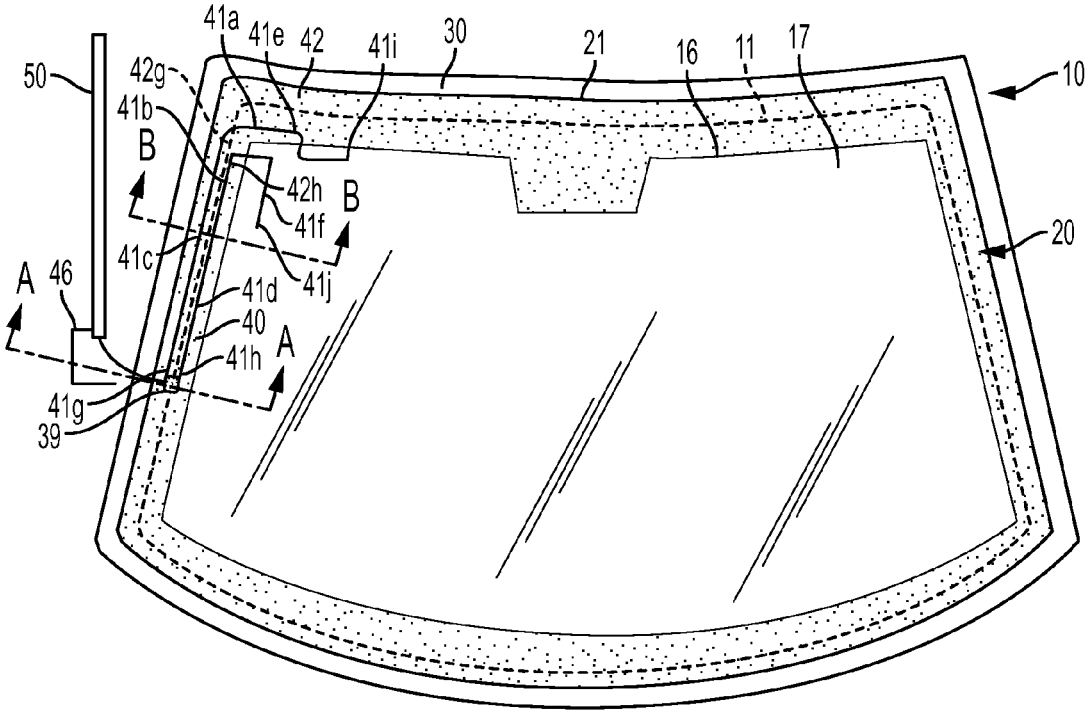
FIG. 1 is a plan view of an antenna windshield that incorporates features of the presently disclosed invention.
Figure 2:
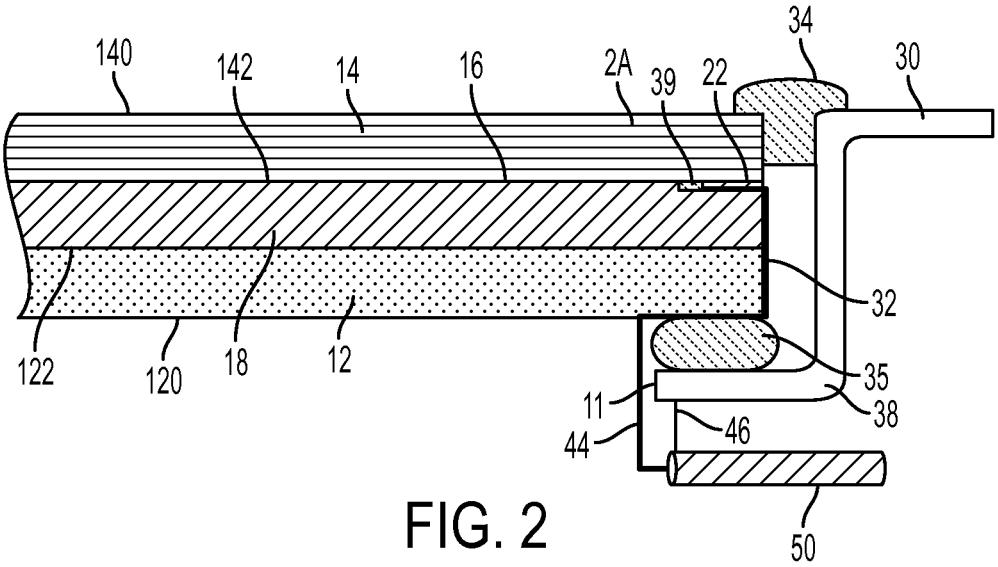
FIG. 2 is sectional view taken along line A-A in FIG. 1.
Figure 3:
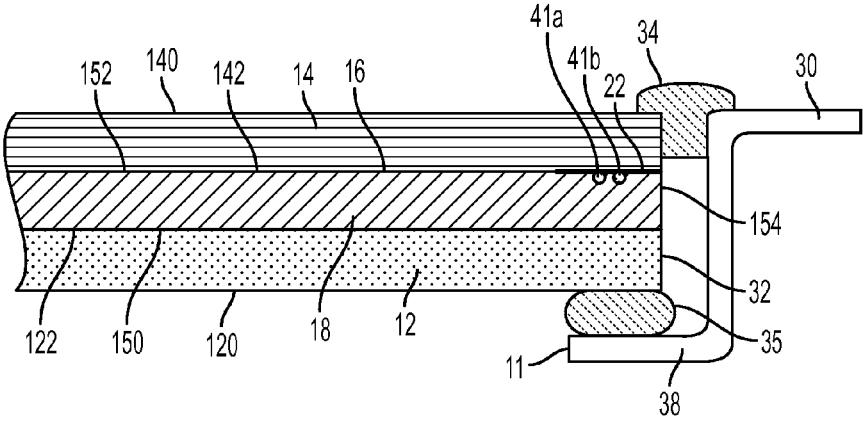
FIG. 3 is sectional view taken along line B-B in FIG. 1.

FIG. 1 is a plan view of the antenna windshield 10 and its associated structure incorporating features of the presently disclosed invention. FIG. 2 is a partial cross-section of FIG. 1 taken along the line A-A of FIG. 1. FIG. 3 is a partial cross-section of FIG. 1 taken along the line B-B of FIG. 1. FIGS. 1, 2 and 3 show that windshield 20 is surrounded by a metal frame with a body 30 having a window edge 11 that defines a window aperture. The outer edge 21 of windshield 20 overlaps the annular flange 38 of body 30 to mount windshield 20 in body 30. As shown in FIG. 2, the sectional view taken along line A-A in FIG. 1 shows an annular sealing member 35 that is placed between window glass 20 and flange 38. FIG. 2 also shows a molding 34 that bridges the outer gap between the body 30 and windshield 20.

The window assembly includes an inner transparent ply 12 that has first and second oppositely disposed surfaces 120 and 122 respectively. The window assembly also includes an outer transparent ply 14 that has first and second oppositely disposed surfaces 142 and 140 respectively. An interlayer 18 is located between the second surface 122 of the inner transparent ply 12 and the first surface 142 of the outer transparent ply 14. FIGS. 1 and 3 show antenna wires 41*a* and 41*b* that have first and second longitudinal ends. Antenna wires 41*a* and 41*b* may be located on at least one of a ply 12 or 14 or the interlayer 18. In the example of the embodiment, wires 41*a* and 41*b* are embedded in one surface of interlayer 18. Each of wires 41*a* and 41*b* have a respective first longitudinal segment, 41*c* and 41*d*, and a second longitudinal segment 41*e* and 41*f* respectively. First longitudinal segment 41*c* defines a first end 41*g* and is joined with second longitudinal segment 41*e* at a second end 42*g* of first longitudinal segment 41*c*. First longitudinal segment 41*d* defines a first end 41*h* and is joined with second longitudinal segment 41*f* at a second end 42*h* of first longitudinal segment 41*d*. Second longitudinal segment 41*e* defines a terminal end 41*i* and second longitudinal segment 41*f* defines a terminal end 41*j*.

The first longitudinal segments 41*c* and 41*d* are positioned in the window assembly such that they are parallel to the portal edge 11 of window frame or body 30. The second longitudinal segments 41*e* and 41*f* are positioned such that at least a portion of the second longitudinal segments 41*e* and 41*f* is non-parallel to the respective first longitudinal segment 41*c* and 41*d* of the respective electrical conductor 41*a* and 41*b*. In the example of the preferred embodiment, the second longitudinal segments 41*e* and 41*f* may be oriented orthogonally with respect to the first longitudinal segment 41*c* and 41*d* of the respective electrical conductor 41*a* and 41*b*.

The window assembly includes an opaque coating such as black paint band 22 that cover a portion of the outer transparent ply 14 adjacent the perimeter edge of the outer transparent ply 14. Antenna wires 41*a* and 41*b* are preferably coated with a dark colored coating to minimize the visibility of that portion of the wires in the daylight opening of the window. Typically, antenna wires 41*a* and 41*b* have a center core with a diameter in the range of 30 μm to 150 μm. Preferably, the antenna wire has a center core with a diameter in the range of 60 μm to 90 μm. One longitudinal end 41*g* and 41*h* of each of first longitudinal segments 41*c* and 41*d* of antenna lines 41*a* and 41*b* are joined together and connected to a conductive solder patch 39.

As illustrated in FIG. 2, a copper foil 32 is galvanically connected to solder patch 39. Copper foil 32 extends outside of the outer edge of the ply 14 or interlayer 18 and is also connected to the center conductor 44 of coaxial cable 50 or other vehicle electronic device (not shown). Preferably copper foil 32 is covered by plastic tape so that it is isolated from contact with window body 30 and shorts out the radio signals. Cable ground 46 is connected to the window body 30 near the inner metal edge 11 of the annular flange 38.

Antenna connector 32, antenna wires 41*a*, 41*b*, and window body 30 forms a coupled transmission line power divider as further explained in connection with FIG. 4.

Figure 4:
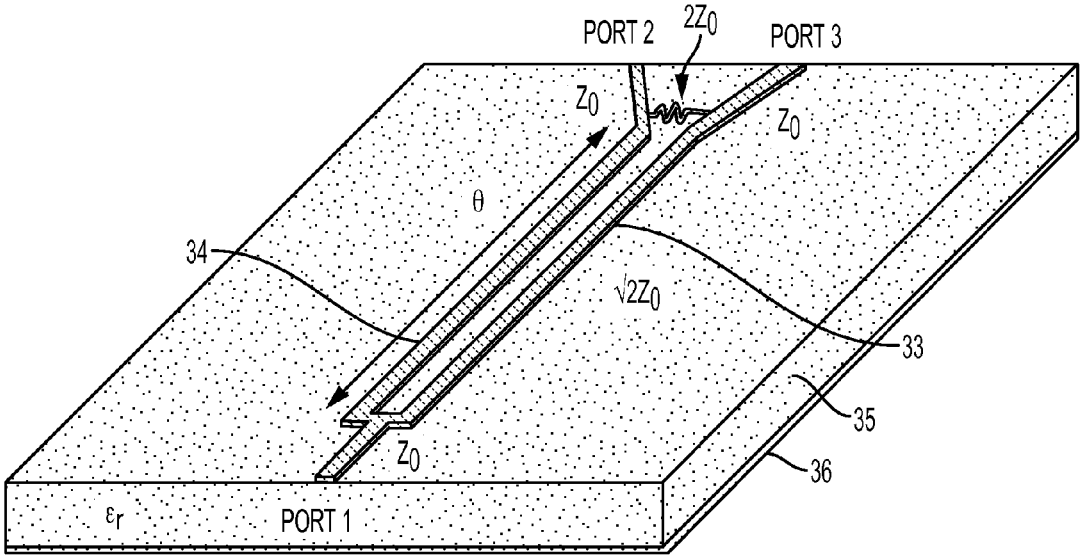
FIG. 4 shows an example of a power divider with coupled transmission lines over a common ground plan.

FIG. 4 shows an example of a power divider using a coupled lines layout. Two coupled transmission lines 33 and 34 lay over a common ground plane 36. Coupled transmission lines 33 and 34 are isolated from ground plane 36 by an insulation layer 35 that has a dielectric constant $\in_r$. $2Z_o$ represents the isolation resistor and θ represents the electrical length of the coupled wires. The electrical behavior of the two coupled transmission lines can be described by reference to an S-parameter matrix of a 3-port device. If the two transmission lines 33 and 34 are identical, there is a plane of circuit symmetry. As a result, odd/even mode analysis can be used to analyze the circuit. The normalized input impedance at port 1 can be written as:

$$\overline{Z}_{in1} = 0.5\overline{Z}_{0e}\frac{1 + j\overline{Z}_{0e}\tan\theta}{\overline{Z}_{0e} + j\tan\theta}$$

Where $\overline{Z}_{0e}$ represents the normalized characteristic impedance of the wires to ground in even mode.

It shows that the input impedance at port 1 is only affected by even mode impedance $Z_{0e}$. Since S11 is only affected by $Z_{in1}$ and assuming the coupled lines are lossless, the input power will be split equally in phase at port 2 and port 3. Therefore, $S_{11}$, $S_{21}$ and $S_{31}$ are only affected by $Z_{0e}$. To achieve a perfect matching at port 1, the characteristic impedance of the coupled lines must be $\sqrt{2}\,Z_0$ and the three parameters $S_{11}$, $S_{21}$ and $S_{31}$ are then fixed.

Similar analysis can be performed on output port 2 and port 3. Since port 2 and port 3 are symmetric, only port 2 is analyzed. The normalized input impedance at port 2 for even and odd modes can be written as:

$$\overline{Z}^{e}_{in2} = \overline{Z}_{0e}\frac{2 + j\overline{Z}_{0e}\tan\theta}{\overline{Z}_{0e} + j2\tan\theta}$$

$$\overline{Z}^{o}_{in2} = \overline{Z}_{0e}\frac{j\overline{Z}_{0o}\tan\theta}{1 + j\overline{Z}_{0o}\tan\theta}$$

Where $\overline{Z}_{0o}$ represents the normalized characteristic impedance of the wires to ground in odd mode.

The reflection coefficients for both modes are:

$$\Gamma_2^{e,o} = \frac{\overline{Z}^{e,o}_{in2} - 1}{\overline{Z}^{e,o}_{in2} + 1}$$

$S_{22}$ is given by $S_{22}=\frac{1}{2}(\Gamma_2^{e}+\Gamma_2^{o})$, and the power from port 2 to port 3 can be written as:

$$|S_{11}|^2 = 1 - 2\left|\frac{\overline{Z}^{o}_{in2}}{\overline{Z}^{o}_{in2} + 1}\right|^2 - |S_{22}|^2 - |S_{21}|^2$$

The above equations demonstrate that both even and odd mode impedance of the coupled lines influences $S_{22}$ and $S_{32}$. However, at the center frequency when $\theta=\pi/2$, the reflection coefficient becomes zero and $S_{22}$ and $S_{32}$ are only determined by $Z_{0e}$. In other words, once the $Z_{0e}$ is equal to $\sqrt{2}Z_0$, the divider's center frequency performance is also defined. By varying the widths of and spacing between of the coupled lines, different $Z_{0e}$ and $Z_{0o}$ can be obtained. Once the spacing is given, a required $Z_{0e}$ can always be achieved with different values of $Z_{0o}$. However, $Z_{0o}$ influences the output ports' matching and isolation as frequency changes.

Referring again to the window antenna as shown in FIG. 1, antenna wires 41*a* and 41*b* is comprised of two sections: the first longitudinal segment which is under the black paint band 22 and is not visible from the inside of the antenna window, and the second longitudinal segment which is within the daylight opening 17 and is visible to vehicle occupants. The first longitudinal segments of wires 41*a*, 41*b* and window frame 30 forms a coupled transmission line power divider as previously explained herein. The second longitudinal segment of wires 41*a* and 41*b* are monopole antennas that radiate and receive radio frequency signals. The first longitudinal segment of wires 41*a* and 41*b* is acting as a power divider that transfers the antenna signal between the second longitudinal segment of antenna wires 41*a* and 41*b* situated inside the daylight opening of the laminated glass and antenna connector 32 laminated partially inside and partially on an exterior surface of the ply such as glass 14.

Providing more than one monopole wire antenna in the antenna windshield achieves wideband performance. For a single wire antenna, the wire length selected to tune the antenna to the center frequency of the working band. When the frequency band is wide, an antenna that is tuned to the center frequency of the band doesn't meet performance requirements in the lower and higher portions of the operation band. With more than one antenna wire, the frequency band can be divided among smaller bands and each antenna wire can be tuned to a relatively narrow band with the narrower bands overlapping each other to achieve antenna performance over the wide bandwidth and better performance.

When two monopoles are closely spaced together, the orientations of the antenna elements can be critical in determining the isolation between the antennas. The isolation can be improved when the two monopoles are orthogonally oriented. Multi-band or wideband antennas can be achieved when improved isolation between the monopoles results in independent tuning of each monopole to different resonant frequencies. In addition, orthogonally oriented monopoles can radiate or receive antenna signals at different polarizations, for example, TV antennas are required to receive radio frequency signals at both horizontal and vertical polarizations. Referring to FIG. 1, wire 41*a* is a more vertically polarized antenna and wire 41*b* is a more horizontally polarized antenna. The combination of both antenna wires satisfies antenna requirements for receiving both vertical and horizontal polarized signals. Closely spaced monopoles also can ensure that radio frequency signals received by each monopole are about the same in amplitude and phase. When the signals from each monopole antenna that are combined at the antenna connector output have the same amplitude and phase, no signal losses are expected at the antenna output.

Figure 5:
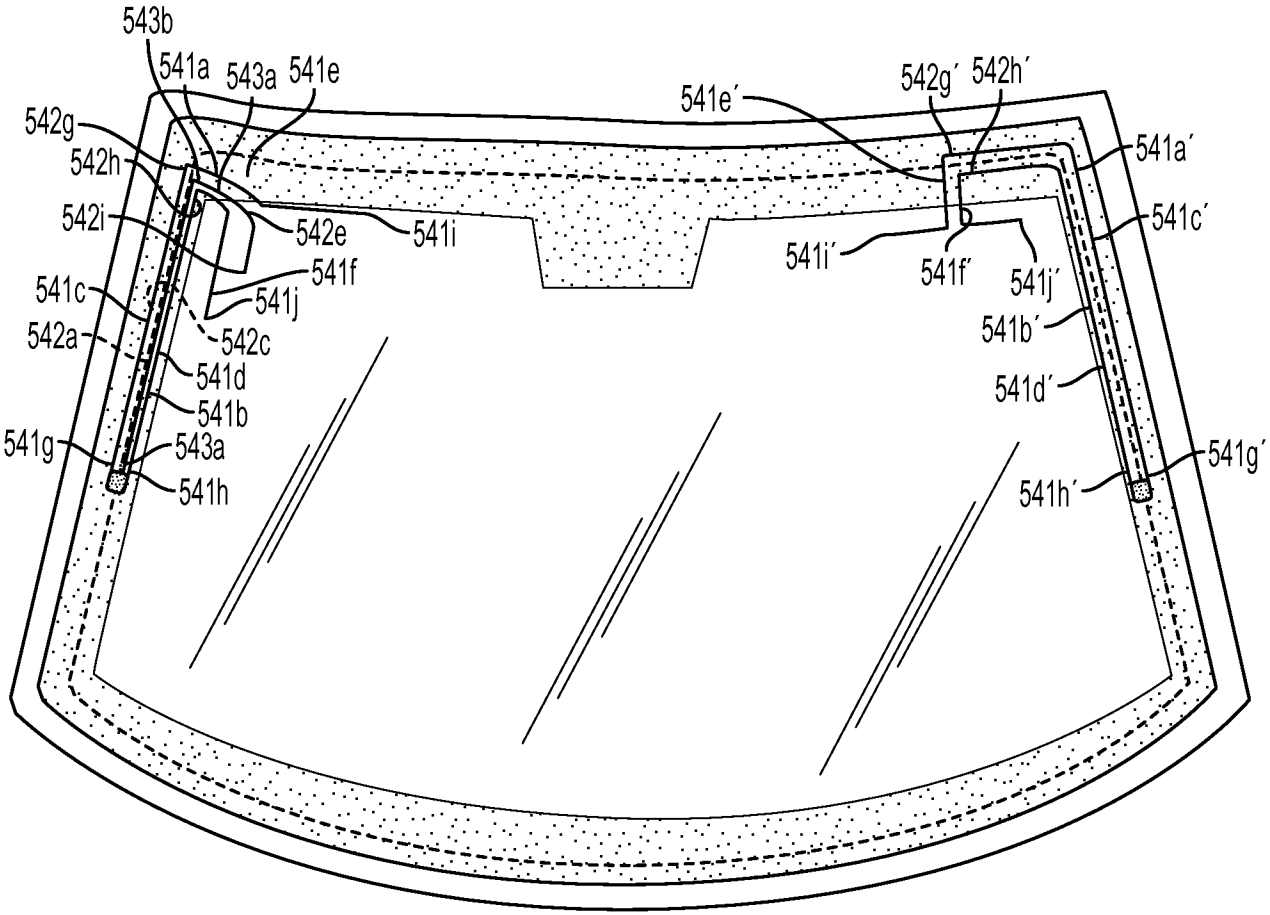
FIG. 5 shows a plan view of another windshield that incorporates features of the presently disclosed invention.

Additional antenna wires can be added to those shown in the presently preferred embodiment of FIGS. 1-3 to further increase antenna bandwidth. FIG. 5 illustrates a wire antenna with three monopoles on the left hand side. FIG. 5 shows antenna wires 541*a*, 541*b* and 542*a* each of which has first and second longitudinal ends. Antenna wires 541*a*, 541*b* and 542*a* may be located on at least one of a ply 12 or 14 or the interlayer 18. In the example of the embodiment, wires 541*a*, 541*b* and 542*a* are embedded in one surface of interlayer 18. Each of wires 541*a*, 541*b* and 542*a* have a respective first longitudinal segment, 541*c*, 541*d* and 542*e*, and a second longitudinal segment 541*e*, 541*f* and 542*e* respectively. First longitudinal segment 541*c* defines a first end 541*g* and is joined with second longitudinal segment 541*e* at a second end 542*g* of first longitudinal segment 541*c*. First longitudinal segment 541*d* defines a first end 541*h* and is joined with second longitudinal segment 541*f* at a second end 542*h* of first longitudinal segment 541*d*. First longitudinal segment 542*c* defines a first end 543*a* and is joined with second longitudinal segment 542*e* at a second end 543*b* of first longitudinal segment 542*c*. Second longitudinal segment 541*e* defines a terminal end 541*i* and second longitudinal segment 541*f* defines a terminal end 541*j*. Second longitudinal segment 542*e* defines a terminal end 542*i*.

The first longitudinal segments 541*c*, 541*d* and 542*c* are positioned in the window assembly such that they are parallel to the portal edge 11 of window frame or body 30. The second longitudinal segments 541*e*, 541*f* and 542*e* are positioned such that at least a portion of the second longitudinal segments 541*e*, 541*f* and 542*e* is non-parallel to the first longitudinal segment 541*c*, 541*d* and 542*c* of the respective electrical conductor 541*a*, 541*b* and 542*a*. In the example of the preferred embodiment, the second longitudinal segments 541*e*, 541*f* and 542*e* may be oriented orthogonally with respect to the first longitudinal segment 541*c*, 541*d* and 542*c* of the respective electrical conductor 541*a*, 541*b* and 542*a*.

In addition to improving the bandwidth, the multiple monopole arms improve antenna performance by adding additional impedance resonance to the antenna which is desirable for wideband antenna applications such as TV antennas. The higher order resonant modes can be used for the TV UHF band such as TV bands 4 and 5. The disadvantages of adding more monopole wires are increased cost and potential aesthetic issue due to the visible wires.

As also shown on the right hand side of FIG. 5, other wire layouts are also possible. FIG. 5 shows antenna wires 541*a*' and 541*b*' that have first and second longitudinal ends. Antenna wires 541*a*' and 541*b*' may be located on at least one of a ply 12 or 14 or the interlayer 18. In the example of the embodiment, wires 541*a*' and 541*b*' are embedded in one surface of interlayer 18. Each of wires 541*a*' and 541*b*' have a respective first longitudinal segment, 541*c*' and 541*d*', and a second longitudinal segment 541*e*' and 541*f*' respectively. First longitudinal segment 541*c*' defines a first end 541*g*' and is joined with second longitudinal segment 541*e*' at a second end 542*g*' of first longitudinal segment 541*c*'. First longitudinal segment 541*d*' defines a first end 541*h*' and is joined with second longitudinal segment 541*f*' at a second end 542*h*' of first longitudinal segment 541*d*'. Second longitudinal segment 541*e*' defines a terminal end 541*i*' and second longitudinal segment 541*f*' defines a terminal end 541*j*'.

The first longitudinal segments 541*c*' and 541*d*' are positioned in the window assembly such that they are parallel to the portal edge 11 of window frame or body 30. The second longitudinal segments 541*e*' and 541*f*' are positioned such that at least a portion of the second longitudinal segments 541*e*' and 541*f*' is non-parallel to the respective first longitudinal segment 541*c*' and 541*d*' of the respective electrical conductor 541*a*' and 541*b*'. In the example of the preferred embodiment, the second longitudinal segments 541*e*' and 541*f*' may be oriented orthogonally with respect to the first longitudinal segment 541*c*' and 541*d*' of the respective electrical conductor 541*a*' and 541*b*'.

Antenna wires 541*a*' and 541*b*' run up and follow the A-pillar of vehicle frame and bend toward the center of the windshield at the top of the windshield. The wires then bend down in the middle of the top right side to form a coupled transmission line. In the daylight opening, the second longitudinal segments 541*e*' and 541*f*' of antenna wires 541*a*' and 541*b*' split away from each other and extend in the opposite direction to form a dipole shape antenna.

The disclosed window wire antenna with a coupled transmission line divider not only provides a convenient structure to feed the antenna, but also affords an opportunity for antenna tuning and impedance matching to maximize radio frequency energy transfer. The antenna feeding structure presents an impedance transfer into the wire antenna with its own impedances. The impedance of the coupled transmission lines can be designed so as to match the wire antenna impedance to the impedance of a coaxial cable or other input impedance of an electronic device. Often, such impedances are defined to be 50Ω. Referring to FIG. 3, the impedance of the coupled line is a function of relative permittivity $\in_r$ of glass plies 12, 14 and interlayer 18, the diameter of wires 41*a* and 41*b*, the spacing between wires 41*a* and 41*b*, the separation of wires 41*a*, 41*b* from window frame 30, and the substrate thickness of glass plies 12, 14 and interlayer 18. These parameters can be designed so as to match the impedance of the coupled transmission line to the wire antenna impedance.

Figure 6:
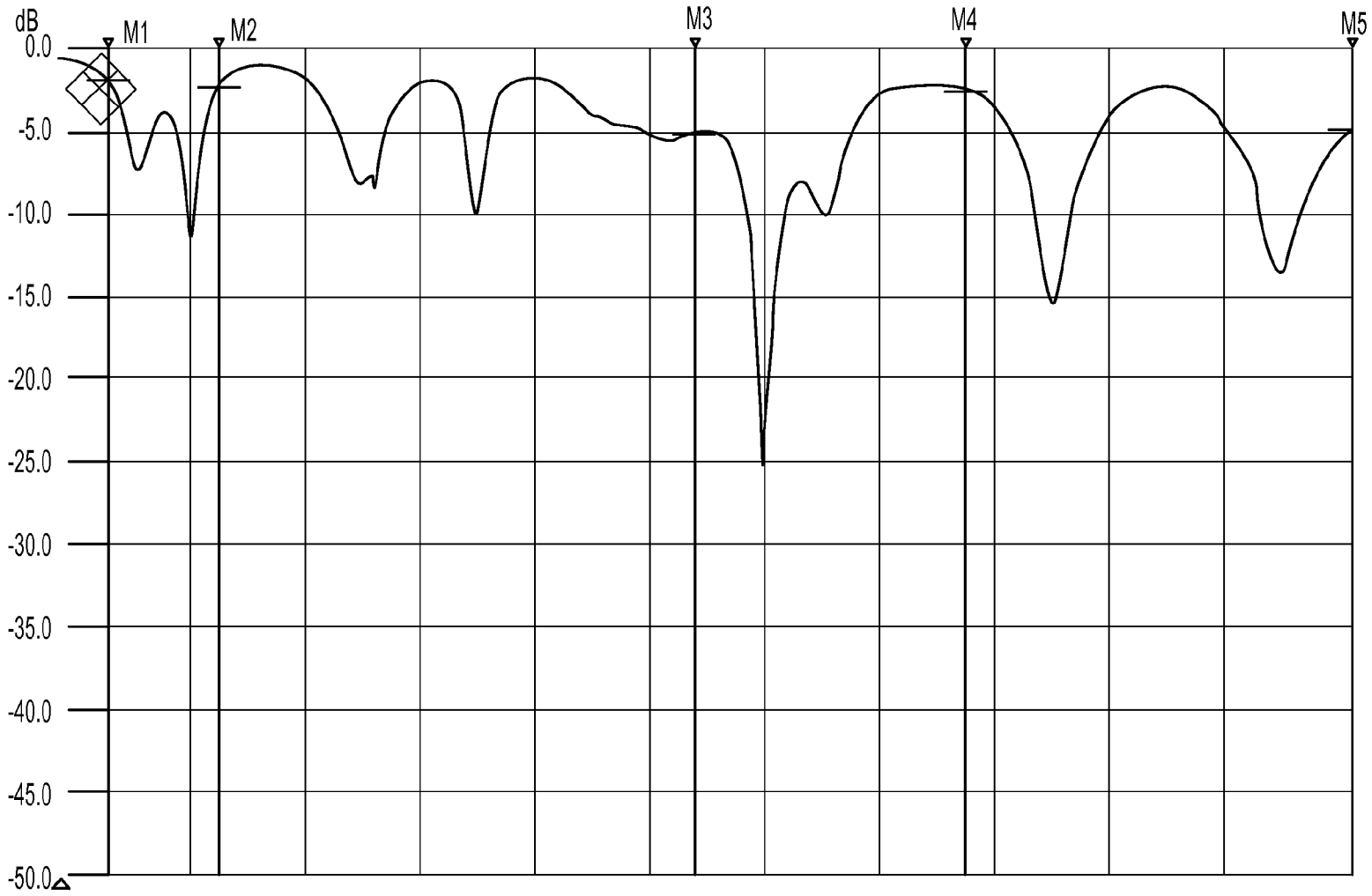
FIG. 6 is a plot of the antenna return loss illustrating the antenna resonant frequency bands from 170 to 800 MHz.

An embodiment similar to that illustrated in FIG. 1 was constructed and tested on a vehicle. FIG. 6 is the plot of the return loss (S11) of the slot antenna. From the power delivered to the antenna, return loss S11 is a measure of the power reflected from the antenna and the power "accepted" by the antenna and radiated. FIG. 6 shows that the antenna resonates well in multiple frequency bands from 170 MHz up to 800 MHZ. That frequency range covers TV band III (174 MHz-230 MHz), digital audio broadcasting (DAB III) (174 MHz-240 MHz), garage door opener (300 MHz-400 MHz), TV band IV and V (474 MHz-860 MHz). Note that the double impedance resonance in each band indicates adding more arms to the wire antenna introduces more resonate modes that increase antenna bandwidth. Results of far-field gain measurements show that the antenna performs very well at all TV bands with equal or better antenna gain compared to traditional embedded wire or silver print window antennas. The wire antenna feed with a coupled transmission line divider demonstrates the capability for multiband application that can reduce the number of antennas, simplify antenna amplifier design, and reduce overall costs for the antenna system.

Figure 7:
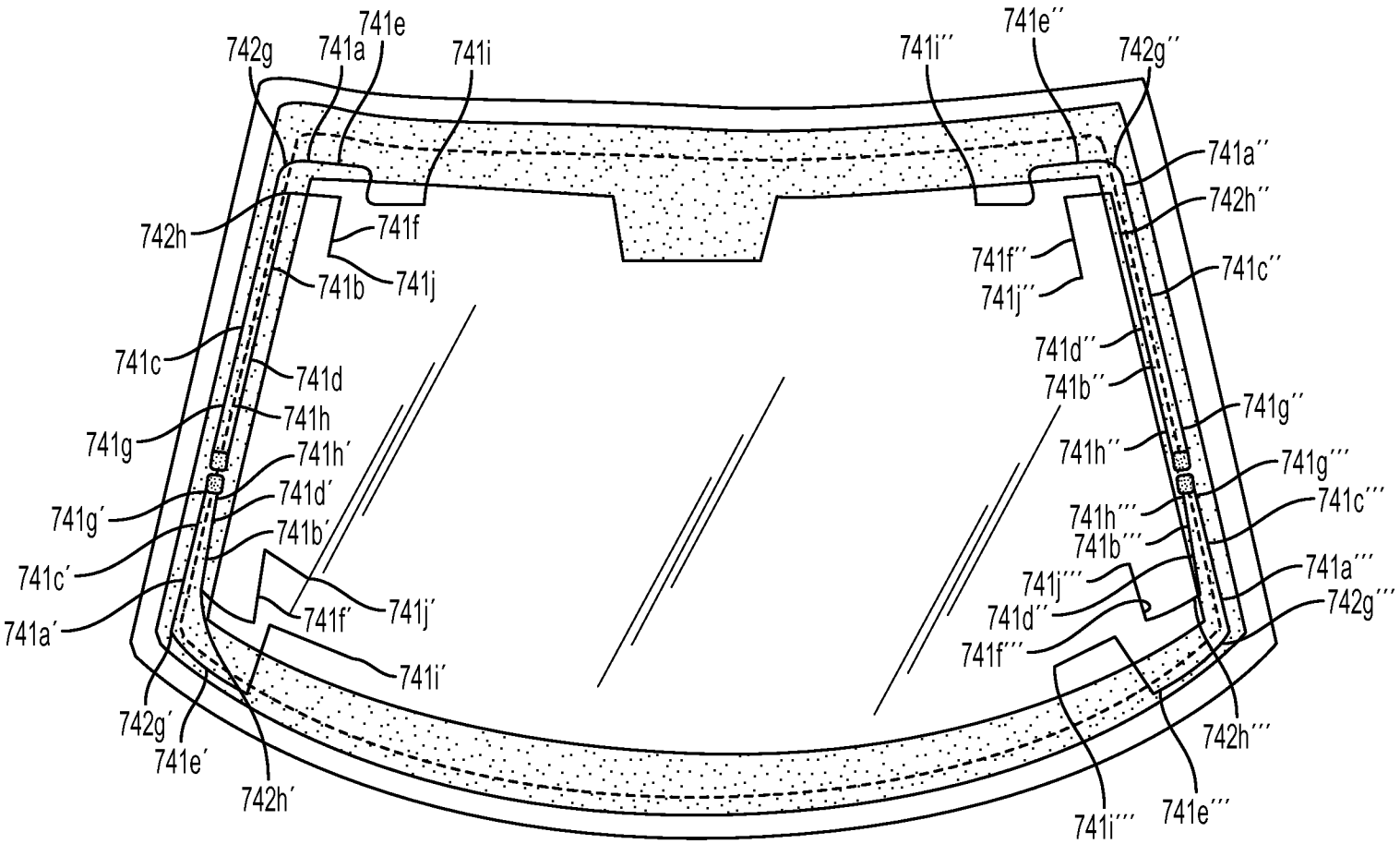
FIG. 7 is a plan view of a windshield wire antenna system with four separate antennas for diversity reception.

The embodiment of FIG. 7 represents a further development in accordance with the presently disclosed invention. A plurality of antennas as herein disclosed can be located, arranged and fed at respective locations around a window opening to form a diverse antenna system that has respective antennas for different applications. A first antenna includes antenna wires 741*a* and 741*b* that have first and second longitudinal ends. Antenna wires 741*a* and 741*b* may be located on at least one of a ply 12 or 14 or the interlayer 18. In the example of the embodiment, wires 741*a* and 741*b* are embedded in one surface of interlayer 18. Each of wires 741*a* and 741*b* have a respective first longitudinal segment, 741*c* and 741*d*, and a second longitudinal segment 741*e* and 741*f* respectively. First longitudinal segment 741*c* defines a first end 741*g* and is joined with second longitudinal segment 741*e* at a second end 742*g* of first longitudinal segment 741*c*. First longitudinal segment 741*d* defines a first end 741*h* and is joined with second longitudinal segment 741*f* at a second end 742*h* of first longitudinal segment 741*d*. Second longitudinal segment 741*e* defines a terminal end 741*i* and second longitudinal segment 741*f* defines a terminal end 741*j*.

The first longitudinal segments 741*c* and 741*d* are positioned in the window assembly such that they are parallel to the portal edge 11 of window frame or body 30. The second longitudinal segments 741*e* and 741*f* are positioned such that at least a portion of the second longitudinal segments 741*e* and 741*f* is non-parallel to the respective first longitudinal segment 741*c* and 741*d* of the respective electrical conductor 741*a* and 741*b*. In the example of the preferred embodiment, the second longitudinal segments 741*e* and 741*f* may be oriented orthogonally with respect to the first longitudinal segment 741*c* and 741*d* of the respective electrical conductor 741*a* and 741*b*.

A second antenna includes antenna wires 741*a*' and 741*b*' that have first and second longitudinal ends. Antenna wires 741*a*' and 741*b*' may be located on at least one of a ply 12 or 14 or the interlayer 18. In the example of the embodiment, wires 741*a*' and 741*b*' are embedded in one surface of interlayer 18. Each of wires 741*a*' and 741*b*' have a respective first longitudinal segment, 741*c*' and 741*d*', and a second longitudinal segment 741*e*' and 741*f*' respectively. First longitudinal segment 741*c*' defines a first end 741*g*' and is joined with second longitudinal segment 741*e*' at a second end 742*g*' of first longitudinal segment 741*c*'. First longitudinal segment 741*d*' defines a first end 741*h*' and is joined with second longitudinal segment 741*f*' at a second end 742*h*' of first longitudinal segment 741*d*'. Second longitudinal segment 741*e*' defines a terminal end 741*i*' and second longitudinal segment 741*f*' defines a terminal end 741*j*'.

The first longitudinal segments 741*c*' and 741*d*' are positioned in the window assembly such that they are parallel to the portal edge 11 of window frame or body 30. The second longitudinal segments 741*e*' and 741*f*' are positioned such that at least a portion of the second longitudinal segments 741*e*' and 741*f*' is non-parallel to the respective first longitudinal segment 741*c*' and 741*d*' of the respective electrical conductor 741*a*' and 741*b*'. In the example of the preferred embodiment, the second longitudinal segments 741*e*' and 741*f*' may be oriented orthogonally with respect to the first longitudinal segment 741*c*' and 741*d*' of the respective electrical conductor 741*a*' and 741*b*'.

A third antenna includes antenna wires 741*a*" and 741*b*" that have first and second longitudinal ends. Antenna wires 741*a*" and 741*b*" may be located on at least one of a ply 12 or 14 or the interlayer 18. In the example of the embodiment, wires 741*a*" and 741*b*" are embedded in one surface of interlayer 18. Each of wires 741*a*" and 741*b*" have a respective first longitudinal segment, 741*c*" and 741*d*", and a second longitudinal segment 741*e*" and 741*f*" respectively. First longitudinal segment 741*c*" defines a first end 741*g*" and is joined with second longitudinal segment 741*e*" at a second end 742*g*" of first longitudinal segment 741*c*". First longitudinal segment 741*d*" defines a first end 741*h*" and is joined with second longitudinal segment 741*f*" at a second end 742*h*" of first longitudinal segment 741*d*". Second longitudinal segment 741*e*" defines a terminal end 741*i*" and second longitudinal segment 741*f*" defines a terminal end 741*j*".

The first longitudinal segments 741*c*" and 741*d*" are positioned in the window assembly such that they are parallel to the portal edge 11 of window frame or body 30. The second longitudinal segments 741*e*" and 741*f*" are positioned such that at least a portion of the second longitudinal segments 741*e*" and 741*f*" is non-parallel to the respective first longitudinal segment 741*c*" and 741*d*" of the respective electrical conductor 741*a*" and 741*b*". In the example of the preferred embodiment, the second longitudinal segments 741*e*" and 741*f*" may be oriented orthogonally with respect to the first longitudinal segment 741*c*" and 741*d*" of the respective electrical conductor 741*a*" and 741*b*".

A fourth antenna includes antenna wires 741*a*'" and 741*b*'" that have first and second longitudinal ends. Antenna wires 741*a*'" and 741*b*'" may be located on at least one of a ply 12 or 14 or the interlayer 18. In the example of the embodiment, wires 741*a*'" and 741*b*'" are embedded in one surface of interlayer 18. Each of wires 741*a*'" and 741*b*'" have a respective first longitudinal segment, 741*c*'" and 741*d*'", and a second longitudinal segment 741*e*'" and 741*f*'" respectively. First longitudinal segment 741*c*'" defines a first end 741*g*'" and is joined with second longitudinal segment 741*e*'" at a second end 742*g*'" of first longitudinal segment 741*c*'". First longitudinal segment 741*d*'" defines a first end 741*h*'" and is joined with second longitudinal segment 741*f*'" at a second end 742*h*'" of first longitudinal segment 741*d*'". Second longitudinal segment 741*e*'" defines a terminal end 741*i*'" and second longitudinal segment 741*f*'" defines a terminal end 741*j*'".

The first longitudinal segments 741*c*'" and 741*d*'" are positioned in the window assembly such that they are parallel to the portal edge 11 of window frame or body 30. The second longitudinal segments 741*e*'" and 741*f*'" are positioned such that at least a portion of the second longitudinal segments 741*e*'" and 741*f*'" is non-parallel to the respective first longitudinal segment 741*c*'" and 741*d*'" of the respective electrical conductor 741*a*'" and 741*b*'". In the example of the preferred embodiment, the second longitudinal segments 741*e*'" and 741*f*'" may be oriented orthogonally with respect to the first longitudinal segment 741*c*'" and 741*d*'" of the respective electrical conductor 741*a*'" and 741*b*'".

As previously described herein, each of the antennas can be tuned to different respective frequency bands. FIG. 7 illustrates four separate wire antennas loaded with a four-coupled transmission line divider incorporated into the windshield. Each antenna is fed independently by a connector that is connected to the solder pad where the coupled lines are connected together. The top two antennas are symmetrically located along two sides of the windshield. The two antenna feeds are at least $\lambda/4$ wavelength apart at FM and TV frequencies so that they are weakly coupled and both can be used simultaneously for an FM and TV diversity antenna system. The same is true for the bottom two antennas that also can be used for FM and TV diversity. Each antenna also can be tuned to resonate at different frequencies for a variety of automotive wireless applications.

While the disclosed invention has been described and illustrated by reference to certain preferred embodiments and implementations, those skilled in the art will understand that various modifications may be adopted without departing from the spirit of the invention or the scope of the following claims.

What is claimed is:

1. A transparency for use with an electrically conductive frame that defines a portal edge, said transparency comprising:

at least one ply having oppositely disposed surfaces that are defined by an outer edge that is located between said oppositely disposed surfaces of said ply;

an interlayer having oppositely disposed surfaces that are defined by an outer edge that is located between said oppositely disposed surfaces of said interlayer with one surface of said interlayer opposing one surface of said ply;

at least two electrical conductors that have a longitudinal shape and that are located on at least one of said one ply and said interlayer, each of said at least two electrical conductors having a respective first longitudinal segment that defines a first end and that is joined with a respective second longitudinal segment that defines a terminal end of the respective electrical conductor, each of said first longitudinal segments being positioned parallel to said portal edge of said frame and each of said second longitudinal segments being positioned such that at least a portion of said second longitudinal segment is non-parallel to the first longitudinal segment of the respective electrical conductor, all of said first ends of said first longitudinal segments being connected together at a junction; and a connector having one end that is electrically connected to the junction of all of said first ends of all of said first longitudinal segments, said connector having an opposite end that extends outside of the outer edge of said at least one ply and the outer edge of said interlayer.

2. The transparency of claim 1 wherein said first segments of said at least two electrical conductors and said connector cooperate with said electrically conductive frame to provide a coupled transmission line power divider.

3. The transparency of claim 1 wherein at least a portion of at least one of said second segment is oriented orthogonally with respect to the first longitudinal segment of the respective electrical conductor.

4. The transparency of claim 2 wherein said electrically conductive frame is connected to an electrical ground.

5. The transparency of claim 4 wherein said connector that conducts a feed signal that is provided to the opposite end of said connector.

6. The transparency of claim 2 wherein said first longitudinal segments of said electrical conductors define a coupled transmission line power divider having a first end where said connector is connected to the junction of said first ends of said first longitudinal segments and a second end where said first longitudinal segments join with the respective second longitudinal segments.

7. The transparency of claim 6 wherein electrical signals to said first end of said coupled transmission line power divider is divided among each of said electrical conductors at said second end of said coupled transmission line power divider.

8. The transparency of claim 7 wherein each of said second longitudinal segments defines a monopole antenna that is combined with said coupled transmission line power divider forms an antenna with a first longitudinal segment and a second longitudinal segment.

9. The transparency of claim 6 wherein the impedance of said coupled transmission line is matched to the characteristic impedance of said antenna wire by adjusting at least one of the relative permittivity of said ply and said interlayer, the separation between the first longitudinal segments, the cross-sectional area of said electrical conductors, the separation between said conductive frame and said first longitudinal segments, and the thickness of said ply and said interlayer.

10. The transparency of claim 2 and further comprising at least one additional coupled transmission line power divider.

11. A transparency as claimed in claim 1 wherein said electrical conductor is a wire that is coated with dark colored coating to minimize visibility, said antenna wire having a center core with a diameter in the range 30 μm to 150 μm.

12. The transparency of claim 11 wherein said antenna wire has a center core with a diameter in the range of 60 μm to 90 μm.

13. The transparency of claim 11 further comprising an opaque coating that covers a portion of said ply that is located adjacent the perimeter edge of said ply and wherein said first longitudinal segment is embedded in one surface of said interlayer at a position that is opposite said opaque coating.

14. The transparency of claim 1 wherein said first longitudinal segments of said antenna wires, said connector, and the vehicle frame define a coupled transmission line power divider with one input port and at least two output ports.

15. An antenna as claimed in claim 14 wherein the second longitudinal segments of said antenna wires are connected to respective ones of said two output ports of said power divider.

16. A transparency as claimed in claim 15 wherein the second longitudinal segment of each of said antenna wires is a monopole antenna, and wherein said connector, said coupled transmission line power divider, and said second longitudinal segment of said antenna wire cooperate to define a multi-element window antenna.

17. The transparency of claim 16 wherein the bandwidth of said a multi-element window antenna is determined by the bandwidth of each monopole antenna.

18. The transparency of claim 16 wherein said multi-element window antenna has a plurality of fundamental and higher order impedance resonates modes such that said multi-element window antenna is suitable for wideband and multiband antenna applications.

19. The transparency of claim 18 wherein additional coupled transmission lines corresponds to wider bandwidth and additional higher-order modes.

20. The transparency of claim 16 wherein said monopole antennas are spaced apart from each other such that radio frequency signals received by each monopole are comparable in phase and amplitude to reduce signal losses as the signals from different monopole antennas are combined at the antenna connector port of said coupled transmission line power divider.

21. The transparency of claim 16 wherein two of said monopole antennas are oriented orthogonally with respect to each other to increase isolation between said monopole antennas.

22. The transparency of claim 21 wherein said monopole antennas are independently tuned to different, respective resonant frequencies to provide one or more of a multi-band antenna and a wideband antenna.

23. The transparency of claim 22 wherein said orthogonally oriented monopole antennas radiate and receive signals at different polarizations.

24. The transparency of claim 23 wherein the impedance of said coupled transmission line is determined according to the relative permittivity $\in_r$ of said glass ply and said interlayer, the spacing between said first longitudinal segments, the diameter of said antenna wire, the spacing between said first longitudinal segments and the frame, the thickness of the ply, the thickness of the interlayer so as to increase the transfer of radio frequency energy between said wires and said connector.

25. The transparency of claim 22 wherein said wire antenna cooperates with a coupled transmission line power divider to transmit and receive radio frequency signals in the range of 170 MHz to 800 MHz.

26. The transparency of claim 25 wherein said wire antenna is loaded with a coupled transmission line power divider, said wire antenna transmitting signals in a frequency band that include TV VHF, TV UHF, garage door opener, and DAB band III frequency bands.

27. The transparency of claim 1 further comprising a plurality of antennas that are located at respective positions within the window opening to provide a system of diverse antennas that are suitable for different applications.

28. The transparency of claim 27 wherein each of the plurality of said antennas are tuned to different, respective frequency bands.

* * * * *